US006775511B2

(12) United States Patent
Kosuge

(10) Patent No.: US 6,775,511 B2
(45) Date of Patent: Aug. 10, 2004

(54) IMAGE FORMING APPARATUS CAPABLE OF ADJUSTING AN AMOUNT OF LUBRICANT TO BE APPLIED ONTO AN IMAGE CARRIER

(75) Inventor: Akio Kosuge, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/231,281

(22) Filed: Aug. 30, 2002

(65) Prior Publication Data

US 2003/0044201 A1 Mar. 6, 2003

(30) Foreign Application Priority Data

Aug. 31, 2001 (JP) ..... 2001-263635
Jul. 31, 2002 (JP) ..... 2002-223133

(51) Int. Cl.[7] ..... G03G 15/00; G03G 21/00
(52) U.S. Cl. ..... 399/346; 399/71
(58) Field of Search ..... 399/346, 343, 399/71, 159, 252, 38, 49; 430/67, 105, 114

(56) References Cited

U.S. PATENT DOCUMENTS

| | | | | |
|---|---|---|---|---|
| 4,647,961 A | | 3/1987 | Kammoto et al. | 358/516 |
| 4,841,358 A | | 6/1989 | Kammoto et al. | 358/512 |
| 4,968,997 A | | 11/1990 | Saitoh et al. | 346/136 |
| 5,194,959 A | | 3/1993 | Kaneko et al. | 348/335 |
| 5,404,206 A | | 4/1995 | Andoh et al. | 399/209 |
| 5,715,501 A | | 2/1998 | Aita et al. | 399/159 |
| 6,014,532 A | * | 1/2000 | Takeichi et al. | 399/71 |
| 6,122,468 A | | 9/2000 | Sakamoto et al. | 399/223 |
| 6,136,491 A | * | 10/2000 | Yamauchi | 399/252 X |
| 6,157,797 A | | 12/2000 | Saito et al. | 399/107 |
| 6,215,974 B1 | | 4/2001 | Katoh et al. | 399/258 |
| 6,249,304 B1 | | 6/2001 | Sawayama et al. | 347/228 |
| 6,256,461 B1 | | 7/2001 | Takeyama et al. | 399/66 |
| 6,292,641 B1 | | 9/2001 | Takeyama et al. | 399/228 |
| 6,308,027 B1 | | 10/2001 | Obu et al. | 399/110 |
| 6,330,420 B1 | * | 12/2001 | Honda | 399/346 |
| 6,562,529 B1 | * | 5/2003 | Kojima et al. | 399/346 X |
| 6,597,885 B2 | * | 7/2003 | Kai et al. | 399/346 X |
| 2002/0037187 A1 | * | 3/2002 | Kai et al. | 399/346 |
| 2003/0049555 A1 | * | 3/2003 | Sakon et al. | 399/346 X |

FOREIGN PATENT DOCUMENTS

| | | | |
|---|---|---|---|
| JP | 1-170951 | | 7/1989 |
| JP | 03-050562 | | 3/1991 |
| JP | 5-165338 | | 7/1993 |
| JP | 08-137354 | * | 5/1996 |
| JP | 8-234642 | | 9/1996 |
| JP | 11-288194 | | 10/1999 |
| JP | 2000-131973 | | 5/2000 |
| JP | 2000-162881 | | 6/2000 |
| JP | 2000-314966 | | 11/2000 |
| JP | 2000-330425 | * | 11/2000 |
| JP | 2001-100591 | * | 4/2001 |
| JP | 2001-201899 | * | 7/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes at least one image carrier that carries an electrostatic latent image on a surface of the image carrier. At least one developing device develops the electrostatic latent image with a developer including a toner to which a first lubricant is added to form a toner image on the surface of the image carrier. A lubricant applying device applies a second lubricant onto the surface of the image carrier. A lubricant application amount adjusting device adjusts an amount of the second lubricant to be applied onto the surface of the image carrier. And, a control device controls the lubricant application amount adjusting device to adjust the amount of the second lubricant to be applied onto the surface of the image carrier according to an area of the toner image formed on the surface of the image carrier.

24 Claims, 4 Drawing Sheets

IMAGE FORMING APPARATUS CAPABLE OF ADJUSTING AN AMOUNT OF LUBRICANT TO BE APPLIED ONTO AN IMAGE CARRIER

CROSS-REFERENCE TO RELATED APPLICATIONS

The present application claims priority to Japanese Patent Application No. 2001-263635 filed in the Japanese Patent Office on Aug. 31, 2001 and Japanese Patent Application No. 2002-223133 filed in the Japanese Patent Office on Jul. 31, 2002, the disclosures of which are hereby incorporated by reference herein in their entirety.

BACKGROUND OF THE INVENTION

1. Field of the Invention

The present invention relates to an electrophotographic image forming apparatus such as a copying machine, a facsimile machine, a printer, or other similar image forming apparatus, and more particularly, to an image forming apparatus that forms stable and high quality images while improving the durability of an electrophotographic photoreceptor.

2. Discussion of the Background

As an electrophotographic photoreceptor (hereafter referred to as a "photoreceptor") for use in an electrophotographic image forming apparatus such as a copying machine, a facsimile machine, a printer, or other similar image forming apparatus, an organic photoreceptor has been used because of its low cost, the ease of mass producing it, and because it is non-polluting. However, as compared to an inorganic photoreceptor, an organic photoreceptor has disadvantages such as decreased durability and reduced abrasion resistance. Recently, a need has existed for a photoreceptor having a small diameter because there is a demand for downsizing electrophotographic systems. Therefore, there is a demand for a photoreceptor having good durability against abrasion that increases in proportion to the number of copies. Thus, mechanical durability, which typically means abrasion resistance, is in strong demand.

Japanese Laid-open Patent Publication No. 1-170951 describes a method for improving abrasion resistance of an organic photoreceptor whose surface includes a protective layer including a filler formed from a metal or a metal oxide. By this background method, a photoreceptor having a high mechanical durability can be obtained. However, in such an organic photoreceptor, the properties of the surface of the photoreceptor may be changed with time, because the surface of the photoreceptor is repeatedly charged with a charging device. As a result, toner of a toner image formed on the photoreceptor tends to adhere to the surface of the photoreceptor, and a transfer efficiency of the toner image formed on the photoreceptor may decrease, thereby causing an inferior image such as a partial omission of a transferred image.

In order to prevent toner from adhering to the surface of the photoreceptor due to the surface property changes of the photoreceptor, a method has been employed in which surface energy of a photoreceptor is decreased by applying a lubricant onto the photoreceptor. As a background method of applying a lubricant onto a photoreceptor, Japanese Laid-open Patent Publication No. 2000-162881 describes a method of applying a lubricant onto a photoreceptor with a lubricant applying member, such as a brush. Further, Japanese Patent No. 2859646 describes a method of applying a lubricant added to a toner onto a photoreceptor. By applying a lubricant onto a surface of a photoreceptor, the surface energy of the photoreceptor is decreased, thereby improving the mechanical durability of the photoreceptor and the transfer efficiency of a toner image, and preventing an occurrence of an inferior image such as a partial omission of a transferred image.

With regard to the application of a lubricant onto a photoreceptor, there are some problems to be addressed. When applying a lubricant onto a photoreceptor with a lubricant applying member such as a brush, a regular maintenance or replacement of the lubricant is required. If a large quantity of lubricant is used in an apparatus to lengthen a maintenance interval, the size and cost of the apparatus increase.

When a lubricant is added to toner and applied onto a photoreceptor, fresh lubricant is applied to the photoreceptor by replacing a toner bottle. Therefore, as compared to the above-described case in which a lubricant is applied onto a photoreceptor with a lubricant applying member, maintenance of the lubricant itself is not required. However, there is a problem that an amount of a lubricant applied onto a photoreceptor depends on an area of a toner image formed on the photoreceptor. Specifically, when a large number of toner images are formed on the photoreceptor and toner of the toner images are transferred onto a transfer material such as a transfer sheet from the photoreceptor, a sufficient amount of lubricants, which are added to the toner, remain and are supplied onto the photoreceptor. However, when a small number of toner images are formed on the photoreceptor, an amount of lubricants supplied onto the photoreceptor decreases accordingly.

SUMMARY OF THE INVENTION

According to a first aspect of the present invention, an image forming apparatus includes at least one image carrier configured to carry an electrostatic latent image on a surface of the at least one image carrier, at least one developing device configured to develop the electrostatic latent image with a developer including a toner to which a first lubricant is added to form a toner image on the surface of the at least one image carrier, a lubricant applying device configured to apply a second lubricant onto the surface of the at least one image carrier, a lubricant application amount adjusting device configured to adjust an amount of the second lubricant to be applied onto the surface of the at least one image carrier, and a control device configured to at least control the lubricant application amount adjusting device to adjust the amount of the second lubricant to be applied onto the surface of the at least one image carrier according to an area of the toner image formed on the surface of the at least one image carrier.

According to another aspect of the present invention, an image forming method includes the steps of carrying an electrostatic latent image on a surface of at least one image carrier, developing the electrostatic latent image with a developer including a toner to which a first lubricant is added to form a toner image on the surface of the at least one image carrier, applying a second lubricant onto the surface of the at least one image carrier, and adjusting an amount of the second lubricant to be applied onto the surface of the at least one image carrier according to an area of the toner image formed on the surface of the at least one image carrier.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
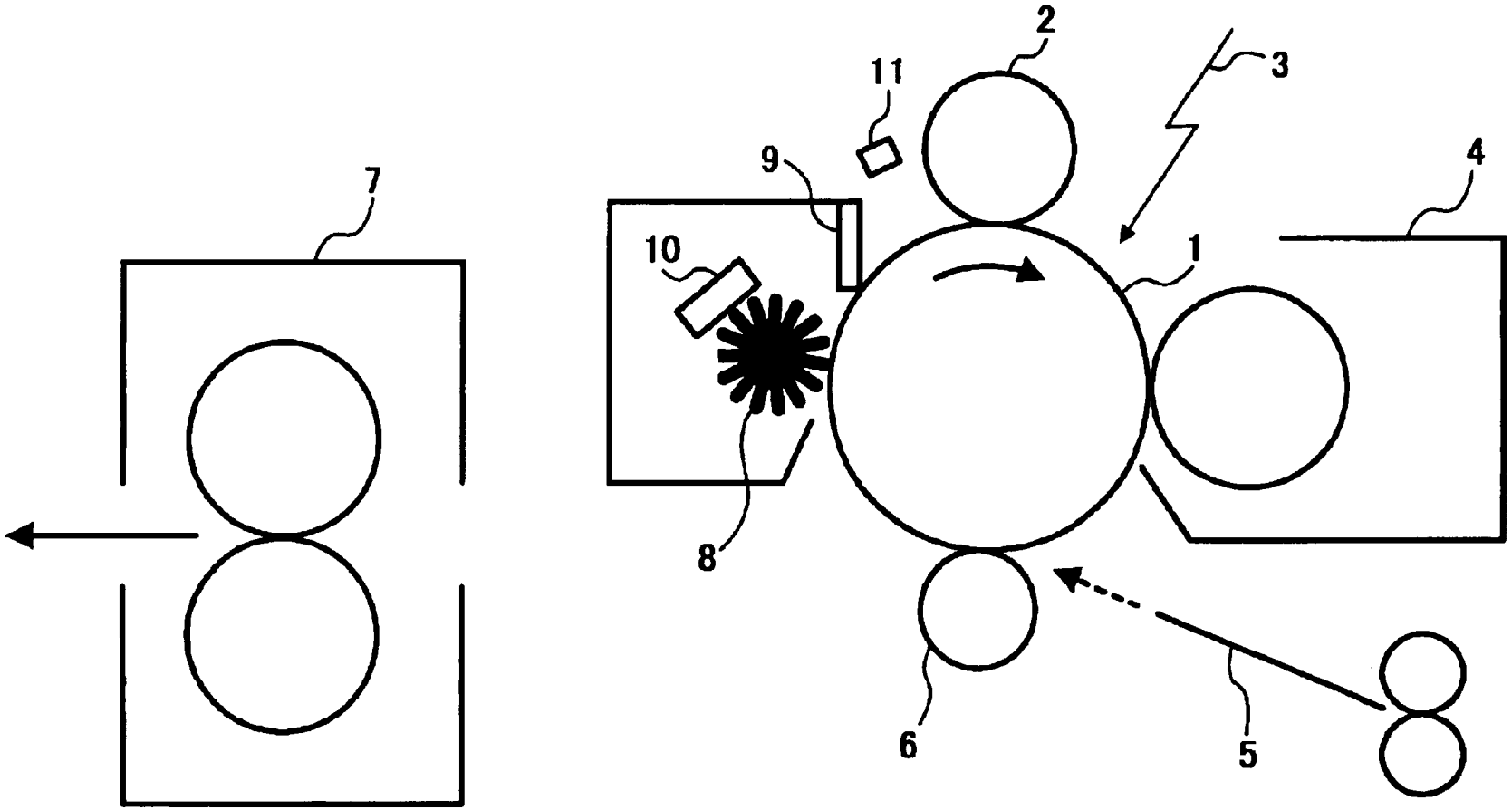
FIG. 1 is a schematic view of an image forming section in an image forming apparatus according to an embodiment of the present invention.

Preferred embodiments of the present invention are described in detail with reference to the drawings, wherein like reference numerals designate identical or corresponding parts throughout the several views.

FIG. 1 is a schematic view of an image forming section in an image forming apparatus according to one embodiment of the present invention. The image forming apparatus of FIG. 1 includes a photoreceptor 1 serving as an image carrier. Referring to FIG. 1, the photoreceptor 1 is in a drum shape. Alternatively, the photoreceptor 1 may be in a shape of a sheet or an endless belt. Arranged around the photoreceptor 1 are a charging roller 2 serving as a charging device; an exposure device (not shown) that exposes the surface of the photoreceptor 1 with a laser light 3 to form an electrostatic latent image on the photoreceptor 1; a developing device 4 that develops the electrostatic latent image formed on the photoreceptor 1 with a toner to form a toner image on the photoreceptor 1; a transfer roller 6 serving as a transfer device that transfers the toner image from the photoreceptor 1 onto a transfer material 5 fed from a sheet feeding device (not shown); a cleaning brush 8 and a cleaning blade 9 serving as a cleaning device that removes residual toner remaining on the photoreceptor 1 after the toner image is transferred onto the transfer material 5 from the photoreceptor 1; and a discharging lamp 11 that discharges the surface of the photoreceptor 1 that has passed the cleaning blade 9. In place of a charging roller, the charging device may be a contact type charging device such as a brush, or a charger. Further, in place of the transfer roller, the transfer device may be a contact type transfer device such as a brush, a belt, or a charger.

The image forming apparatus of FIG. 1 further includes a fixing device 7 at a downstream side of a nip part formed between the photoreceptor 1 and the transfer roller 6 in a transfer material conveying direction, to fix the toner image onto the transfer material 5.

Figure 2:
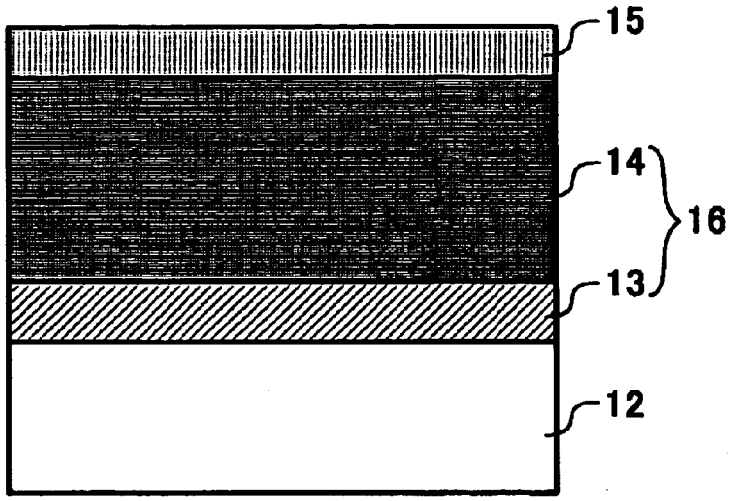
FIG. 2 is a schematic cross-sectional view of a multilayer electrophotographic photoreceptor in the image forming apparatus of FIG. 1.

Hereinafter, the details of the photoreceptor 1 used in the image forming apparatus according to the present embodiment will be described. FIG. 2 is a schematic cross-sectional view of a multilayer electrophotographic photoreceptor according to the present embodiment. The photoreceptor 1 includes an electroconductive substrate 12, a photosensitive layer 16 including a charge generation layer 13 formed from a charge generation material and a charge transport layer 14 formed from a charge transport material, and a protective layer 15 as a surface layer. The photosensitive layer 16 is located overlying the electroconductive substrate 12.

The electroconductive substrate 12 is made of a material having a conductivity such that its volume resistivity is $10^{10}$ ohm-cm or less, for example, tube-shaped metals such as aluminium and stainless steel, and endless-belt shaped metals such as nickel.

The charge generation layer 13 is formed from a charge generation material. Examples of the charge generation materials include monoazo pigments, disazo pigments, trisazo pigments, and phthalocyanine pigments. The charge generation layer 13 is formed by dispersing the charge generation material with a binder resin such as polycarbonate resins, in a solvent such as tetrahydrofuran and cyclohexanone, and applying the dispersion liquid obtained. Application of the dispersion liquid is performed by dip-coating, spray-coating, etc. The thickness of the charge generation layer 13 is typically from approximately 0.01 $\mu$m to approximately 5 $\mu$m, and preferably from approximately 0.1 $\mu$m to approximately 2 $\mu$m.

The charge transport layer 14 is formed by dissolving or dispersing a charge transport material and a binder resin in an appropriate solvent such as tetrahydrofuran, toluene, and dichlorethane, and by applying and drying the liquid obtained. If required, a plasticizer, a leveling agent, or the like may be also added.

In the charge transport materials, low-molecular-weight charge transport materials are grouped into electron transport materials and hole transport materials. Examples of the electron transport materials include electron-accepting substances such as chloranil, bromanil, tetracyanoethylene, tetracyanoquinodimethane, 2,4,7-trinitro-9-fluorenone, 2,4,5,7-tetranitro-9-fluorenone, 1,3,7-trinitrodibenzothiophen-5,5-dioxide, and the like.

Examples of the hole transport materials include electron-releasing substances such as oxazole derivatives, oxadiazole derivatives, imidazole derivatives, triphenylamine derivatives, phenylhydrazone, $\alpha$-phenylstilbene derivatives, thiazole derivatives, triazole derivatives, phenazine derivatives, acridine derivatives, and thiophene derivatives.

Specific examples of the binder resins for use in the charge transport layer 14 together with the charge transport material include thermoplastic or thermosetting resins such as polystyrene resins, styrene-acrylonitrile copolymers, styrene-butadiene copolymers, polyester resins, polyarylate resins, polycarbonate resins, acrylic resins, epoxy resins, melamine resins, and phenol resins. The thickness of the charge transport layer 14 may be selected from a range of approximately 5 $\mu$m to approximately 30 $\mu$m according to the required properties of the photoreceptor 1.

In the multilayer electrophotographic photoreceptor 1, an undercoat layer can be formed between the electroconductive substrate 12 and the photosensitive layer 16. The undercoat layer typically includes a resin as a main component. Considering that the photosensitive layer 16 is coated on the undercoat layer with a solvent, the resin preferably has good resistance against a general organic solvent. Specific examples of such resins include water-soluble resins such as polyvinyl alcohol resins; alcohol-soluble resins such as nylon copolymers; and thermosetting resins forming a three-dimensional network such as polyurethane resins, alkyd-melamine resins, and epoxy resins.

The undercoat layer may include a fine powder of metal oxides such as titanium oxides, silica, and alumina to prevent occurrence of moiré in the resultant images and to decrease the residual potential of the resultant photoreceptor. Similarly as in the photosensitive layer 16, the undercoat layer can be formed using a suitable solvent and a suitable coating method. The thickness of the undercoat layer is preferably from approximately 0 μm to approximately 5 μm.

The protective layer 15 including a filler is formed on the photoreceptor 1 as a surface layer to protect the photosensitive layer 16 and to improve the durability. Examples of fillers added to the protective layer 15 include fine powders of metal oxides such as titanium oxides, silica, and alumina. Particularly, alumina is most preferably used.

It is preferable that an average particle diameter of a filler is from approximately 0.1 μm to approximately 0.8 μm. If the average particle diameter of a filler is too large, the exposure light is scattered by the protective layer 15, thereby lowering resolving power, resulting in a deterioration of an image quality. If the average particle diameter of a filler is too small, the abrasion resistance decreases.

The amount of the filler added to the protective layer 15 is preferably from approximately 10 to approximately 40% by weight, and more preferably from approximately 20 to approximately 30% by weight. If the amount of the filler is less than approximately 10% by weight, the abrasion increases and the durability decreases. If the amount is greater than approximately 40% by weight, the sensitivity significantly decreases and the residual potential of the photoreceptor increases.

The protective layer 15 is formed by dispersing a filler and a binder resin in an appropriate solvent, and applying the dispersion liquid obtained onto the photosensitive layer 16 by a spray coating method. As binder resins and solvents for use in the protective layer 15, materials similar to those used in the charge transport layer 14 may be used. The thickness of the protective layer 15 is preferably from approximately 3 μm to approximately 10 μm. A charge transport material and an antioxidant may be added to the protective layer 15.

Next, a developer used in the developing device 4 will be described. The developer used in the developing device 4 is a two-component developer including a mixture of toner and carrier. The carrier in the two-component developer includes magnetic particles having a particle diameter of about 50 μm such as ferrite, magnetite, and iron. The surface of the magnetic particle is covered with resins such as silicone resins, by a spray coating method. The toner in the two-component developer includes particles of binder resins such as ester resins, acrylic resins, and styrene resins; pigment; charge controlling agent, which are mixed, ground, and classified. In addition, external additives such as silica and titania are added to the classified particles. The particle diameter of toner is about 7 μm.

The developer used in the image forming apparatus according to the present embodiment includes a first lubricant. Examples of the first lubricant include a metallic soap of zinc stearate, etc. and a powder of fluororesin, etc. In the developer, the first lubricant is added to the toner. The particle diameter of the first lubricant added to the toner is preferably from approximately 0.5 μm to approximately 5 μm. The amount of the first lubricant added to the toner is preferably from approximately 0.01% to approximately 0.5% by weight.

The first lubricant is adhered onto the surface of the photoreceptor 1 together with toner and is spread out on the surface of the photoreceptor 1 by the cleaning blade 9. The first lubricant thereby decreases the surface energy of the photoreceptor 1, and prevents the occurrence of filming due to paper powder and toner, and prevents the occurrence of inferior images such as resulting from a partial omission of a transferred image.

The image forming apparatus according to the present embodiment further includes a lubricant applying device that applies a second lubricant to the photoreceptor 1. The lubricant applying device can be individually provided in the image forming apparatus. However, for saving space in the image forming apparatus, the cleaning brush 8 may also serve as a lubricant applying device as illustrated in FIG. 1. In this embodiment, a second lubricant 10 is provided on the opposite side of the cleaning brush 8 relative to the photoreceptor 1. As the second lubricant 10, a metallic soap of zinc stearate and a bar or sheet-shaped fluororesin may be used.

It is preferable that the first lubricant added to the toner and the second lubricant 10 applied onto the surface of the photoreceptor 1 by the lubricant applying device are formed from the same materials. By using the same materials for the first and second lubricants, undesired frictional charging between the first and second lubricants and an occurrence of an inferior image such as a dirty background of an image can be prevented. Particularly, it is preferable that the first and second lubricants are made of zinc stearate in view of its lubricating efficiency.

Figure 3:
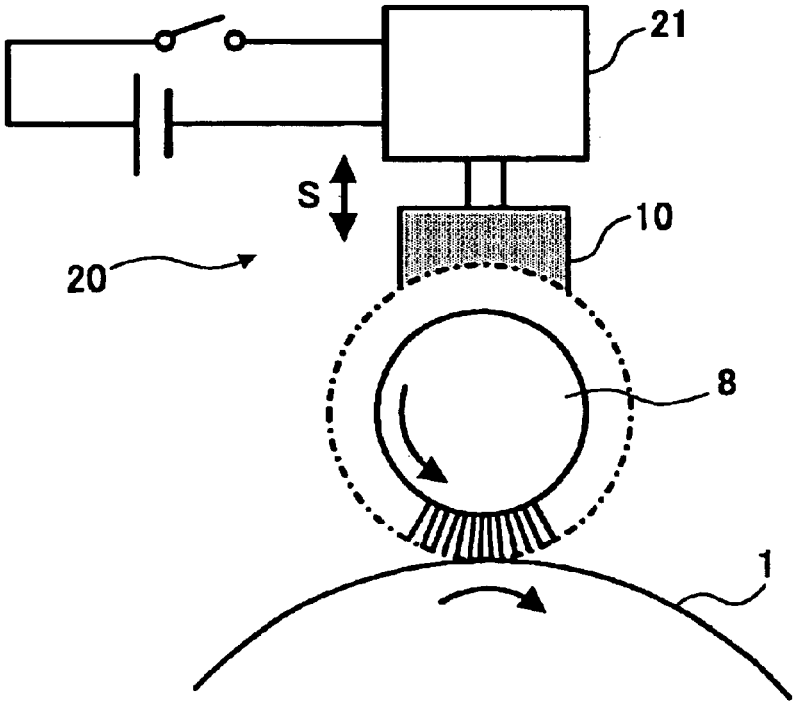
FIG. 3 is a schematic view for explaining a lubricant application amount adjusting device in the image forming apparatus of FIG. 1.

FIG. 3 is a schematic view for explaining a lubricant application amount adjusting device 20 in the image forming apparatus of FIG. 1. The lubricant application amount adjusting device 20 adjusts the amount of the second lubricant 10 to be applied onto the surface of the photoreceptor 1. The lubricant application amount adjusting device 20 includes a solenoid 21 to which the second lubricant 10 is attached.

The second lubricant 10 is shifted in a direction indicated by a double-headed arrow A by an on and off operation of the solenoid 21 in accordance with a signal transmitted from a control device in a main body of the image forming apparatus. Thereby, the second lubricant 10 is switched to be brought into contact with and separated from the cleaning brush 8. As a result, the amount of the second lubricant 10 to be applied onto the surface of the photoreceptor 1 may be adjusted. By bringing the second lubricant 10 into contact with the cleaning brush 8 intermittently, the useful lifetime of the second lubricant 10 may be extended.

In FIG. 3, the exemplary lubricant application amount adjusting device 20 uses the solenoid 21. Alternatively, the lubricant application amount adjusting device 20 may use cams and gears instead of the solenoid 21. In this alternative example, the second lubricant 10 may be shifted in the direction indicated by the double-headed arrow A by rotating the cam and gears, thereby adjusting the amount of the second lubricant 10 to be applied onto the surface of the photoreceptor 1.

The second lubricant 10 is shifted in a direction indicated by a double-headed arrow S by an on and off operation of the solenoid 21 in accordance with a signal transmitted from a control device in a main body of the image forming apparatus. Thereby, the second lubricant 10 is switched to be brought into contact with and separated from the cleaning brush 8. As a result, the amount of the second lubricant 10 to be applied onto the surface of the photoreceptor 1 may be adjusted. By bringing the second lubricant 10 into contact with the cleaning brush 8 intermittently, the useful lifetime of the second lubricant 10 may be extended.

In FIG. 3, the exemplary lubricant application amount adjusting device 20 uses the solenoid 21. Alternatively, the lubricant application amount adjusting device 20 may use cams and gears instead of the solenoid 21. In this alternative example, the second lubricant 10 may be shifted in the direction indicated by the double-headed arrow S by rotating the cams and gears, thereby adjusting the amount of the second lubricant 10 to be applied onto the surface of the photoreceptor 1.

At the same time, the main control board 30 detects the number or time of rotations of a photoreceptor drive motor 17 and counts a number of rotations of the photoreceptor 1. Further, the main control board 30 calculates an image forming area of the photoreceptor 1 and stores a value of the image forming area of the photoreceptor 1 therein. Specifically, the image forming area of the photoreceptor 1 is obtained by the following calculation:

$$A \times B \times C,$$

in which A is an image forming width of the photoreceptor 1 in an axial direction of the photoreceptor 1, B is a peripheral length of the photoreceptor 1, and C is a number of rotations of the photoreceptor 1.

Based on the number of image writing pixels and the image forming area of the photoreceptor 1 during a period of a predetermined number of rotations of the photoreceptor 1, the main control board 30 calculates a ratio of an area of toner images to the image forming area of the photoreceptor 1 by the following calculation:

$$D/E,$$

in which D is the number of image writing pixels and E is the image forming area of the photoreceptor 1.

The main control board 30 determines an amount of the second lubricant 10 to be applied onto the surface of the photoreceptor 1 in a period of a predetermined number of rotations of the photoreceptor 1 for a subsequent image formation based on the calculation result (i.e., the ratio of an area of toner images to an image forming area of the photoreceptor 1). In accordance with the amount of the second lubricant 10 to be applied onto the surface of the photoreceptor 1 determined by the main control board 30, the main control board 30 controls the lubricant application amount adjusting device 20 to adjust a time of contacting the second lubricant 10 with the cleaning brush 8.

When the ratio of an area of toner images to the image forming area of the photoreceptor 1 is low or falls below a predetermined value, the main control board 30 controls the lubricant application amount adjusting device 20 to increase the frequency of contacting the second lubricant 10 with the cleaning brush 8. Thereby, an amount of the lubricant applied to the photoreceptor 1 may be adequately maintained. When the ratio of an area of toner images to the image forming area of the photoreceptor 1 is high or above a predetermined value, the main control board 30 controls the lubricant application amount adjusting device 20 to decrease the frequency of contacting the second lubricant 10 with the cleaning brush 8 while separating the second lubricant 10 from the cleaning brush 8. Thereby, excess use of the second lubricant 10 may be prevented and the useful lifetime of the second lubricant 10 may be extended.

With the above-described calculation of the ratio of an area of toner images to the image forming area of the photoreceptor 1 by the main control board 30, the amount of the first lubricant supplied onto the surface of the photoreceptor 1 may be accurately obtained irrespective of image forming conditions in which toner images are formed on various sizes of transfer materials such as, for example, A3, A4, B4, B5 sizes, and toner images are continuously or intermittently formed on the transfer materials. Therefore, an adequate amount of the second lubricant 10 may be applied onto the photoreceptor 1.

Next, a description will be given of an image forming operation of the image forming apparatus illustrated in FIG. 1.

The surface of the photoreceptor 1 is uniformly charged by the charging roller 2. The charged surface of the photoreceptor 1 is exposed to the laser light 3 emitted from the exposure device (not shown) in accordance with image data, and thereby an electrostatic latent image is formed on the surface of the photoreceptor 1. The developing device 4 develops the electrostatic latent image formed on the photoreceptor 1 with a developer, and thereby a toner image is formed on the photoreceptor 1. Subsequently, the toner image is transferred onto the transfer material 5 fed from a transfer material feeding device (not shown) by the transfer roller 6 serving as a transfer device. The toner image is fixed onto the transfer material 5 by heat and pressure in the fixing device 7.

The residual toner remaining on the photoreceptor 1 after the toner image is transferred onto the transfer material 5 is removed by the cleaning brush 8 and the cleaning blade 9. Further, the second lubricant 10 scraped off by the cleaning brush 8 is applied onto the surface of the photoreceptor 1. The surface of the photoreceptor 1 having passed the cleaning blade 9 is discharged by the discharging lamp 11 in preparation for a next image forming operation.

Having generally described this invention, further understanding may be obtained by reference to certain specific examples provided herein for illustration only and that are not intended to be limiting.

In the example, an undercoat layer coating liquid, a charge generation layer coating liquid, a charge transport layer coating liquid, and a protective layer coating liquid were coated and dried on an aluminium substrate having a diameter of 30 mm in the order mentioned to prepare a photoreceptor having an undercoat layer 3.5 $\mu$m thick, a charge generation layer 0.15 $\mu$m thick, a charge transport layer 20 $\mu$m thick, and a protective layer 5 $\mu$m thick.

A spray coating method was used for coating the protective layer, and a dip coating method was used for coating the other layers. 25% by weight of alumina having an average particle of 0.3 $\mu$m was added to the protective layer.

0.15% by weight of a zinc stearate powder was added into the toner of the two-component developer used in the developing device. The solid zinc stearate as a lubricant having a cross-section of 5 mm×5 mm and a length of 320 mm was provided at the cleaning brush such that the zinc stearate is intermittently brought into contact with the cleaning brush. The exposure light was that of a laser beam having a wavelength of 655 nm, and AC (2 kHz, 1.8 kVpp) and DC (−750V) were applied to the charging roller. The process speed was set to 125 mm/sec.

In the electrophotographic process thus set, the durability of the photoreceptor was evaluated. The quality of the produced image was good at the beginning, and also good after 150,000 copies of A4-sized transfer materials were continuously produced, irrespective of an occupation ratio of an image on an A4-sized transfer material. The abrasion loss of the photoreceptor after 150,000 copies were continuously produced was substantially even in the longitudinal direction of the photoreceptor and was about 2.2 $\mu$m.

Next, a description will be given of a first comparative example. In the first comparative example, the procedure for preparation and evaluation of the photoreceptor was performed in a manner similar to the above-described example, except that a lubricant was not provided at the cleaning brush. As a result, when an occupation ratio of an image on an A4-sized transfer material was 5%, the quality of the produced image was good after 150,000 copies of A4-sized transfer materials were continuously produced. The abrasion loss of the photoreceptor after 150,000 copies were continuously produced was 3.5 $\mu$m.

However, when an occupation ratio of an image on an A4-sized transfer material was 1.5%, the produced image had black stripes due to a failure of cleaning after 90,000 copies of A4-sized transfer materials were continuously produced. The abrasion loss of the photoreceptor after 90,000 copies were continuously produced was 6.3 $\mu$m, and the protective layer was removed due to the abrasion.

Next, a description will be given of a second comparative example. In the second comparative example, the procedure for preparation and evaluation of the photoreceptor was performed in a manner similar to the above-described example, except that a lubricant was not added to a toner and a lubricant was provided in contact with the cleaning brush. As a result, unevenness of the lubricant applied onto the photoreceptor occurred due to the abrasion of the lubricant after 120,000 copies of A4-sized transfer materials were continuously produced, thereby causing a density unevenness in a halftone image portion. The abrasion loss of the photoreceptor was 3.0 $\mu$m or less, irrespective of an occupation ratio of an image on an A4-sized transfer material.

The present invention may be applied to both single-color image forming devices and multi-color image forming devices. For example, the present invention can be applied to a tandem type image forming apparatus including a plurality of photoreceptors.

Figure 5:
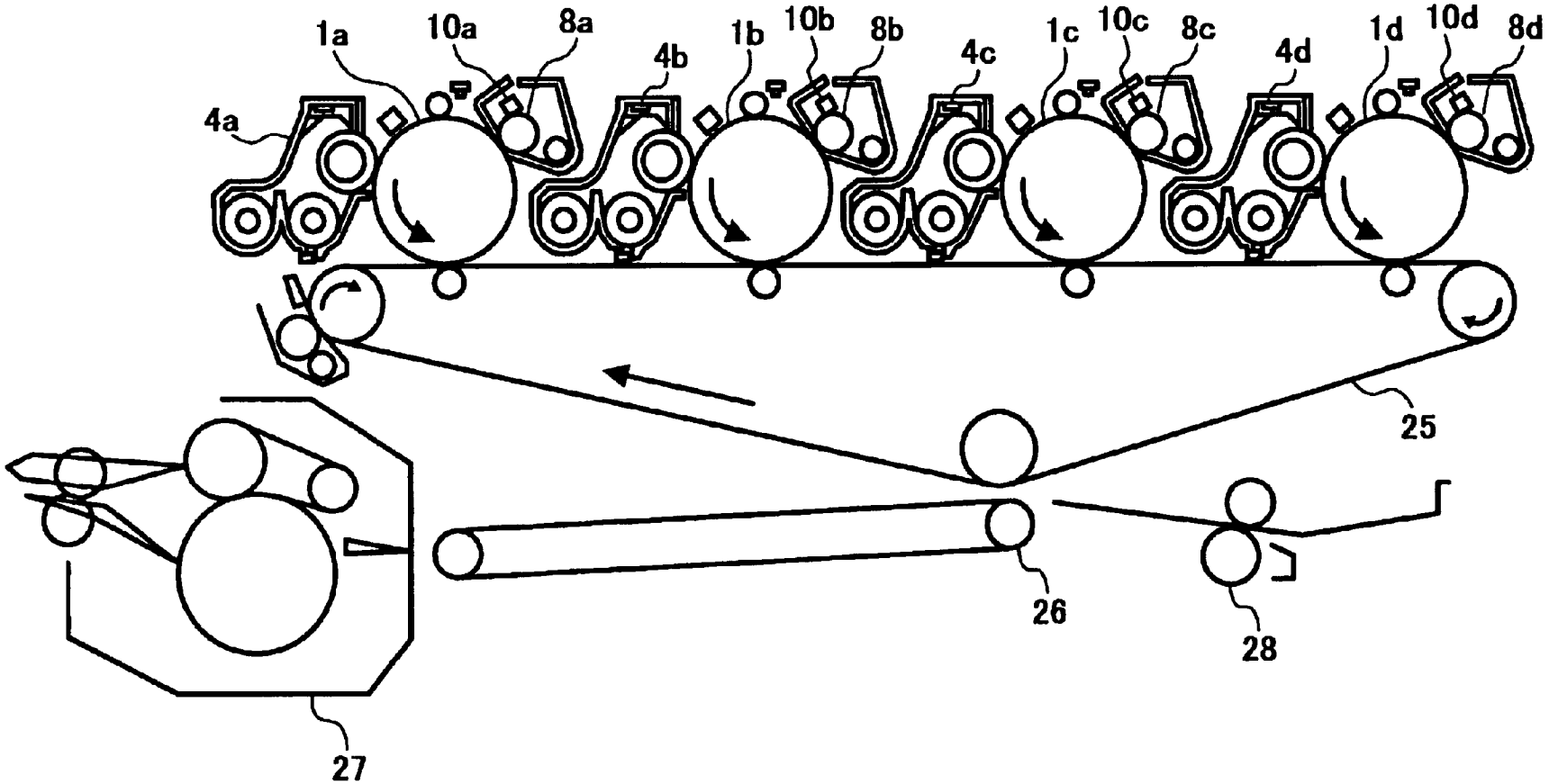
FIG. 5 is a schematic view of an image forming section in a tandem type image forming apparatus according to another embodiment of the present invention.

FIG. 5 is a schematic view of an image forming section in a tandem type image forming apparatus according to another embodiment of the present invention. The image forming section includes an endless belt-shaped intermediate transfer element 25 spanned around three support rollers; four photoreceptors 1*a*, 1*b*, 1*c*, 1*d* serving as image carriers that carry electrostatic latent images to be respectively formed into, for example, a black toner image, a yellow toner image, a magenta toner image, a cyan toner image; developing devices 4*a*, 4*b*, 4*c*, 4*d* that develop the electrostatic latent images on the photoreceptors 1*a*, 1*b*, 1*c*, 1*d* with developer including color toner to form toner images of respective colors; and cleaning brushes 8*a*, 8*b*, 8*c*, 8*d* that remove residual toner remaining from the surfaces of the photoreceptors 1*a*, 1*b*, 1*c*, 1*d* after a primary transfer (i.e., transfer from the photoreceptors 1*a*, 1*b*, 1*c*, 1*d* to the intermediate transfer element 25).

An exposure device (not shown) irradiates the surfaces of the photoreceptors 1*a*, 1*b*, 1*c*, 1*d* with laser lights in accordance with image data, thereby forming electrostatic latent images on the surfaces of the photoreceptors 1*a*, 1*b*, 1*c*, 1*d*. The developing devices 4*a*, 4*b*, 4*c*, 4*d* develop the electrostatic latent images formed on the photoreceptors 1*a*, 1*b*, 1*c*, 1*d* with developer, and thereby toner images of respective colors are formed on the surfaces of the photoreceptors 1*a*, 1*b*, 1*c*, 1*d*.

Substantially simultaneously, the intermediate transfer element 25 is rotated by driving one of the support rollers to rotate. The black, yellow, magenta, and cyan toner images on the photoreceptors 1*a*, 1*b*, 1*c*, 1*d* are sequentially transferred onto the intermediate transfer element 25 so that the black, yellow, magenta, and cyan toner images are superimposed on the same surface of the intermediate transfer element 25 with each other in alignment. Thereby, a superimposed color toner image is formed on the intermediate transfer element 25.

On the other hand, a transfer material (not shown) conveyed from a transfer material feeding section is abutted against a pair of registration rollers 28. The registration rollers 28 feed the transfer material toward a secondary transfer nip part formed between the intermediate transfer element 25 and a secondary transfer roller 26 such that the leading edge of the transfer material is aligned with the leading edge of the superimposed color toner image formed on the intermediate transfer element 25. The color toner image on the intermediate transfer element 25 is transferred onto the transfer material at the secondary transfer nip part under the influence of a secondary transfer electric field and a contact pressure while applying a secondary transfer bias to the secondary transfer roller 26.

Subsequently, the transfer material having a color toner image is conveyed to a fixing device 27. The color toner image is fixed onto the transfer material by heat and pressure in the fixing device 27. Similarly as in the image forming apparatus of FIG. 1, the developer used in each of the developing devices 4*a*, 4*b*, 4*c*, 4*d* includes a first lubricant added to toner. Further, the tandem type image forming apparatus of FIG. 5 includes lubricant applying devices that apply second lubricants 10*a*, 10*b*, 10*c*, 10*d* to the photoreceptors 1*a*, 1*b*, 1*c*, 1*d*, respectively. In this embodiment, the cleaning brushes 8*a*, 8*b*, 8*c*, 8*d* serve as lubricant applying devices that apply the second lubricants 10*a*, 10*b*, 10*c*, 10*d* to the photoreceptors 1*a*, 1*b*, 1*c*, 1*d*, respectively.

The tandem type image forming apparatus of FIG. 5 further includes lubricant application amount adjusting devices (not shown) that adjust the amounts of the second lubricants 10*a*, 10*b*, 10*c*, 10*d* to be applied onto the surfaces of the photoreceptors 1*a*, 1*b*, 1*c*, 1*d*, respectively. The mechanisms of the lubricant application amount adjusting devices in the tandem type image forming apparatus are similar to that of the lubricant application amount adjusting device 20 employed in the image forming apparatus of FIG. 1. Their illustration and description are therefore omitted here.

In the tandem type image forming apparatus, a ratio of an area of color toner images to an image forming area of the photoreceptor differs between the photoreceptors 1*a*, 1*b*, 1*c*, 1*d*.

Figure 4:
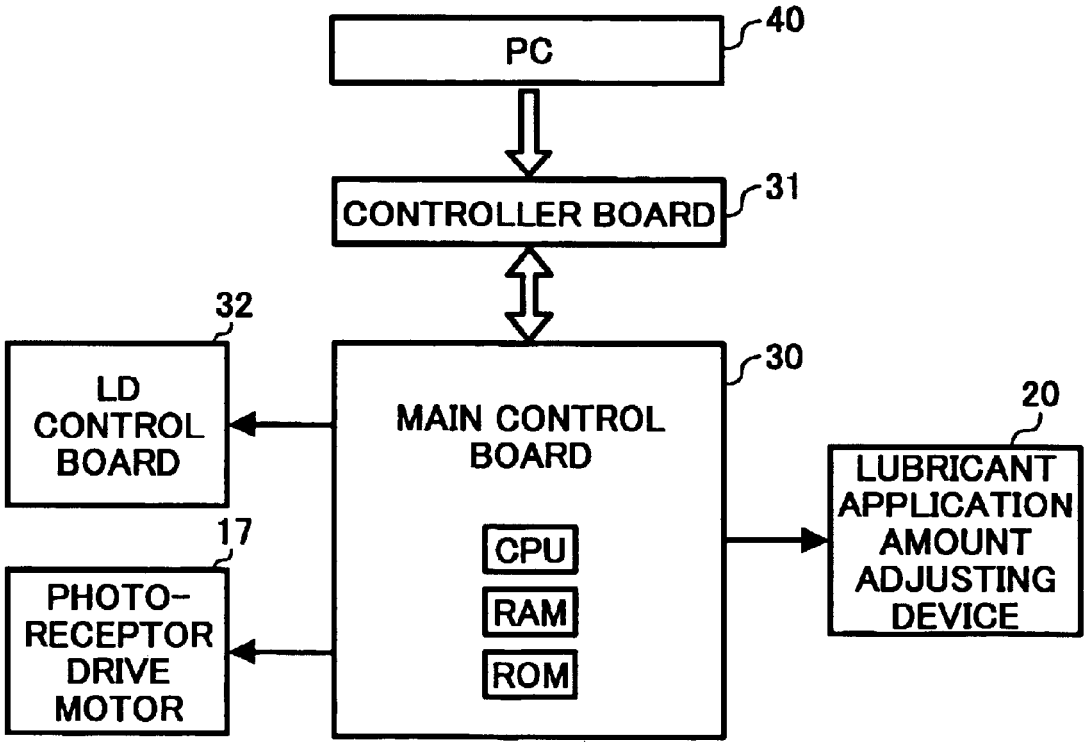
FIG. 4 is a block diagram for explaining a control operation of a control device that controls the lubricant application amount adjusting device of FIG. 3.

The tandem type image forming apparatus also includes the main control board 30 serving as a control device illustrated in FIG. 4. Similarly as in the image forming apparatus of FIG. 1, the main control board 30 counts a number of image writing pixels in each of the photoreceptors 1*a*, 1*b*, 1*c*, 1*d* and stores each number of the image writing pixels therein.

At substantially the same time, the main control board 30 detects the number or time of rotations of each of the photoreceptor drive motors (not shown) that drive the photoreceptors 1*a*, 1*b*, 1*c*, 1*d* to rotate, and counts each number of rotations of the photoreceptors 1*a*, 1*b*, 1*c*, 1*d*. Further, the main control board 30 calculates each image forming area of the photoreceptors 1*a*, 1*b*, 1*c*, 1*d* in a way similar to the above. Based on the number of image writing pixels and the image forming area of the photoreceptor during a period of a predetermined number of rotations of the photoreceptor, the main control board 30 calculates a ratio of an area of color toner images to the image forming area of the photoreceptor in each of the photoreceptors 1*a*, 1*b*, 1*c*, 1*d*.

Similarly as in the image forming apparatus of FIG. 1, the main control board 30 determines each amount of the second lubricants 10*a*, 10*b*, 10*c*, 10*d* to be applied onto the surfaces of the photoreceptors 1*a*, 1*b*, 1*c*, 1*d* in a period of a predetermined number of rotations of the photoreceptor for a subsequent image formation based on the calculation result. In accordance with the amounts of the second lubricants 10*a*, 10*b*, 10*c*, 10*d* to be applied onto the surfaces of the photoreceptors 1*a*, 1*b*, 1*c*, 1*d* determined by the main control board 30, the main control board 30 controls the lubricant application amount adjusting devices to adjust each time of contacting the second lubricants 10*a*, 10*b*, 10*c*, 10*d* with the cleaning brushes 8*a*, 8*b*, 8*c*, 8*d*, respectively.

With the above-described control operations of the main control board 30 in the tandem type image forming apparatus, the amounts of the second lubricants 10*a*, 10*b*, 10*c*, 10*d* to be applied onto the surfaces of the photoreceptors 1*a*, 1*b*, 1*c*, 1*d* may be adequately adjusted by the lubricant application amount adjusting devices. Thereby, each amount of the lubricant applied to the photoreceptors 1*a*, 1*b*, 1*c*, 1*d* may be adequately maintained, so that the surface conditions of the photoreceptors 1*a*, 1*b*, 1*c*, 1*d* may be maintained in a good manner.

In the above-described single-color image forming apparatus of FIG. 1 and multi-color image forming apparatus of FIG. 5, the developer used in the developing device includes a first lubricant added to a toner, and a lubricant applying device is provided to apply a second lubricant onto the surface of the photoreceptor. By doing so, the lubricant may be regularly applied to the surface of the photoreceptor, thereby decreasing the surface energy of the photoreceptor. As a result, the transfer efficiency of a toner image may be improved, so that an occurrence of an inferior image such as a partial omission of a transferred image may be prevented. Further, with provision of the protective layer including a filler on the surface of the photoreceptor, the photoreceptor may obtain high abrasion resistance and good durability. As a result, a stable and high image quality can be obtained in the image forming apparatus for a long period of time.

The present invention has been described with respect to the embodiments as illustrated in figures. However, the present invention is not limited to the embodiments and may be practiced otherwise.

According to the above-described embodiments, the main control board 30 determines an amount of the second lubricant to be applied onto the surface of the photoreceptor based on the ratio of an area of toner images to the image forming area of the photoreceptor. Alternatively, the main control board 30 may detect an amount of developer decreased in a developer container and adjust an amount of the second lubricant to be applied onto the surface of the photoreceptor based on the detection output.

In the above-described tandem type image forming apparatus, the order of forming images of respective colors and/or the arrangement of the developing devices for respective colors are not limited to the ones described above and can be practiced otherwise.

Moreover, the present invention is shown applied to a tandem type color image forming apparatus including a plurality of photoreceptors and developing devices for forming images of respective colors. Alternatively, the present invention may be applied to other similar devices, such as to a multi-color image forming apparatus employing a revolving development station including a plurality of developing devices containing toner of respective colors.

Numerous additional modifications and variations of the present invention are possible in light of the above teachings. It is therefore to be understood that within the scope of the appended claims, the present invention may be practiced otherwise than as specifically described herein.

What is claimed:

1. An image forming apparatus, comprising:

at least one image carrier configured to carry an electrostatic latent image on a surface of the at least one image carrier;

at least one developing device configured to develop the electrostatic latent image with a developer including a toner to which a first lubricant is added to form a toner image on the surface of the at least one image carrier;

a lubricant applying device configured to apply a second lubricant onto the surface of the at least one image carrier;

a lubricant application amount adjusting device configured to adjust an amount of the second lubricant to be applied onto the surface of the at least one image carrier; and a control device configured to at least control the lubricant application amount adjusting device to adjust the amount of the second lubricant to be applied onto the surface of the at least one image carrier according to a ratio of an area of the toner image formed on the surface of the at least one image carrier to an image forming area of the at least one image carrier.

2. The image forming apparatus according to claim 1, wherein the surface of the at least one image carrier comprises a protective layer including a filler.

3. The image forming apparatus according to claim 2, wherein the filler is alumina.

4. The image forming apparatus according to claim 2, wherein an average particle diameter of the filler is from approximately 0.1 $\mu$m to approximately 0.8 $\mu$m.

5. The image forming apparatus according to claim 2, wherein the filler is included in the protective layer in an amount of from approximately 10% to approximately 40% by weight based on a total weight of the protective layer.

6. The image forming apparatus according to claim 1, wherein the control device controls the lubricant application amount adjusting device to increase the amount of the second lubricant to be applied onto the surface of the at least one image carrier when the area of the toner image formed on the surface of the at least one image carrier is less than a predetermined value.

7. The image forming apparatus according to claim 1, wherein the first and second lubricants are formed from substantially identical materials.

8. The image forming apparatus according to claim 7, wherein the first and second lubricants include zinc stearate.

9. The image forming apparatus according to claim 1, wherein the at least one developing device comprises a plurality of developing devices configured to develop electrostatic latent images carried on the surface of the at least one image carrier with the developer to each form toner images of different colors.

10. An image forming method, comprising:

carrying an electrostatic latent image on a surface of at least one image carrier;

developing the electrostatic latent image with a developer including a toner to which a first lubricant is added to form a toner image on the surface of the at least one image carrier;

applying a second lubricant onto the surface of the at least one image carrier; and adjusting an amount of the second lubricant to be applied onto the surface of the at least one image carrier according to a ratio of an area of the toner image formed on the surface of the at least one image carrier to an image forming area of the at least one image carrier.

11. The image forming method according to claim 10, wherein the adjusting comprises increasing the amount of the second lubricant to be applied onto the surface of the at least one image carrier when the area of the toner image formed on the surface of the at least one image carrier is less than a predetermined value.

12. The image forming method according to claim 10, wherein the developing comprises developing the electrostatic latent image with the developer to form toner images of different colors.

13. An image forming apparatus, comprising:

image carrying means for carrying an electrostatic latent image on a surface of the image carrying means;

developing means for developing the electrostatic latent image with a developer including a toner to which a first lubricant is added to form a toner image on the surface of the image carrying means;

lubricant applying means for applying a second lubricant onto the surface of the image carrying means;

lubricant application amount adjusting means for adjusting an amount of the second lubricant to be applied onto the surface of the image carrying means; and control means for at least controlling the lubricant application amount adjusting means to adjust the amount of the second lubricant to be applied onto the surface of the image carrying means according to a ratio of an area of the toner image formed on the surface of the image carrying means to an image forming area of the image carrying means.

14. The image forming apparatus according to claim 13, wherein the surface of the image carrying means comprises a protective layer including a filler.

15. The image forming apparatus according to claim 14, wherein the filler is alumina.

16. The image forming apparatus according to claim 14, wherein an average particle diameter of the filler is from approximately 0.1 $\mu$m to approximately 0.8 $\mu$m.

17. The image forming apparatus according to claim 14, wherein the filler is included in the protective layer in an amount of from approximately 10% to approximately 40% by weight based on a total weight of the protective layer.

18. The image forming apparatus according to claim 13, wherein the control means controls the lubricant application amount adjusting means to increase the amount of the second lubricant to be applied onto the surface of the image carrying means when the area of the toner image formed on the surface of the image carrying means is less than a predetermined value.

19. The image forming apparatus according to claim 13, wherein the first and second lubricants are formed from substantially identical materials.

20. The image forming apparatus according to claim 19, wherein the first and second lubricants include zinc stearate.

21. The image forming apparatus according to claim 13, wherein the developing means develops electrostatic latent images with the developer to form toner images of different colors.

22. An image forming apparatus, comprising:

at least one image carrier configured to carry an electrostatic latent image on a surface of the at least one image carrier;

at least one developing device configured to develop the electrostatic latent image with a developer including a toner to which a first lubricant is added to form a toner image on the surface of the at least one image carrier;

a lubricant applying device configured to apply a second lubricant onto the surface of the at least one image carrier;

a lubricant application amount adjusting device configured to adjust an amount of the second lubricant to be applied onto the surface of the at least one image carrier; and a control device configured to at least control the lubricant application amount adjusting device to adjust the amount of the second lubricant to be applied onto the surface of the at least one image carrier according to an area of the toner image formed on the surface of the at least one image carrier, wherein the control device controls the lubricant application amount adjusting device to increase the amount of the second lubricant to be applied onto the surface of the at least one image carrier when the area of the toner image formed on the surface of the at least one image carrier is less than a predetermined value.

23. An image forming method, comprising:

carrying an electrostatic latent image on a surface of at least one image carrier;

developing the electrostatic latent image with a developer including a toner to which a first lubricant is added to form a toner image on the surface of the at least one image carrier;

applying a second lubricant onto the surface of the at least one image carrier; and adjusting an amount of the second lubricant to be applied onto the surface of the at least one image carrier according to an area of the toner image formed on the surface of the at least one image carrier, wherein the adjusting comprises increasing the amount of the second lubricant to be applied onto the surface of the at least one image carrier when the area of the toner image formed on the surface of the at least one image carrier is less than a predetermined value.

24. An image forming apparatus, comprising:

image carrying means for carrying an electrostatic latent image on a surface of the image carrying means;

developing means for developing the electrostatic latent image with a developer including a toner to which a first lubricant is added to form a toner image on the surface of the image carrying means;

lubricant applying means for applying a second lubricant onto the surface of the image carrying means;

lubricant application amount adjusting means for adjusting an amount of the second lubricant to be applied onto the surface of the image carrying means; and control means for at least controlling the lubricant application amount adjusting means to adjust the amount of the second lubricant to be applied onto the surface of the image carrying means according to an area of the toner image formed on the surface of the image carrying means, wherein the control means controls the lubricant application amount adjusting means to increase the amount of the second lubricant to be applied onto the surface of the image carrying means when the area of the toner image formed on the surface of the image carrying means is less than a predetermined value.

* * * * *